US009890987B2

(12) United States Patent
Dirnberger et al.

(10) Patent No.: US 9,890,987 B2
(45) Date of Patent: Feb. 13, 2018

(54) ICE-MAKING ASSEMBLY FOR A REFRIGERATOR OR FREEZER

(71) Applicant: emz-Hanauer GmbH & Co. KGaA, Nabburg (DE)

(72) Inventors: Albert Dirnberger, Neunburg v.W. (DE); Roland Schroedel, Reichenschwand (DE); Josef Bauriedl, Neunburg v.W. (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 48 days.

(21) Appl. No.: 15/046,617

(22) Filed: Feb. 18, 2016

(65) Prior Publication Data

US 2016/0252287 A1 Sep. 1, 2016

(30) Foreign Application Priority Data

Feb. 26, 2015 (DE) ..... 10 2015 002 424

(51) Int. Cl.
*F25C 1/24* (2006.01)
*F25C 5/06* (2006.01)

(52) U.S. Cl.
CPC ..... *F25C 1/24* (2013.01); *F25C 5/06* (2013.01); *F25C 2400/06* (2013.01); *F25D 2317/061* (2013.01)

(58) Field of Classification Search
CPC ..... F25C 1/24; F25C 2400/06; F25C 5/04; F25C 2305/022; F25C 5/06; F25C 5/005; F25C 1/10; F25D 2317/061; F25D 23/10; F25D 23/04
USPC ..... 62/440
See application file for complete search history.

(56) References Cited

U.S. PATENT DOCUMENTS

| | | | | |
|---|---|---|---|---|
| 8,161,767 | B2 * | 4/2012 | Hwang | F25C 1/24 62/135 |
| 2007/0151282 | A1 * | 7/2007 | Jeong | F25C 1/04 62/349 |
| 2010/0089075 | A1 * | 4/2010 | Park | F25C 1/04 62/66 |
| 2010/0126203 | A1 * | 5/2010 | Kim | F25C 5/185 62/344 |

FOREIGN PATENT DOCUMENTS

| | | | |
|---|---|---|---|
| CN | 103423950 | A | 12/2013 |
| JP | 09310946 | A | 12/1997 |
| JP | 2003279221 | A | 10/2003 |

* cited by examiner

*Primary Examiner* — Mohammad M Ali
(74) *Attorney, Agent, or Firm* — Robert R. Deleault, Esq.; Mesmer & Deleault, PLLC

(57) ABSTRACT

An ice-making assembly for installation in a domestic refrigerator or freezer is provided. The ice-making assembly comprises: a frame structure; and first and second ice-making trays supported for rotation about a rotational axis with respect to the frame structure between an ice production position and an ice discharge position, wherein the first and second ice-making trays are disposed behind one another in a direction of the rotational axis and each have a tray longitudinal dimension in the direction of the rotational axis that is larger than a tray width direction in a direction transverse to the rotational axis.

7 Claims, 7 Drawing Sheets

ICE-MAKING ASSEMBLY FOR A REFRIGERATOR OR FREEZER

BACKGROUND OF THE INVENTION

1. Field of the Invention

The present invention relates generally to an ice-making assembly for installation in a domestic refrigerator or freezer.

2. Description of the Prior Art

In higher-quality refrigerators or freezers in particular, it is increasingly the practice to equip these appliances with an ice maker, with which pieces of ice, e.g. in cube form, can be produced. On the one hand, a high production capacity (i.e. a large quantity of ice that can be produced per unit of time) is aspired to in the case of such ice makers, on the other hand a high production capacity of the ice maker is often accompanied by a correspondingly enlarged size of the ice maker, for which adequate space is not available inside the appliance in common household refrigerators or/and freezers JP 09-310946 A shows in its figures an ice maker with two ice cube trays, which are each longer than they are wide and are arranged adjacent to one another transversely to their longitudinal extension. The two ice cube trays are each rotatable about their own axis of rotation in order to rotate the trays into a discharge position, in which the ice cubes produced in them can fall out of the trays.

SUMMARY OF THE INVENTION

Embodiments of the present invention provide an ice-making assembly for installation in a domestic refrigerator or freezer, the ice-making assembly comprising: a frame structure; first and second ice-making trays supported for rotation about a rotational axis with respect to the frame structure between an ice production position and an ice discharge position, wherein the first and second ice-making trays are disposed behind one another in a direction of the rotational axis and each have a tray longitudinal dimension in the direction of the rotational axis that is larger than a tray width direction in a direction transverse to the rotational axis. By arranging the ice-making trays with their long side behind one another, instead of longitudinally adjacent to one another, they do not take up any more construction space in width than an ice-making assembly with a single ice-making tray of the same tray size. In the longitudinal tray direction, however, the adequate interior depth often present in domestic refrigerators or freezers can be used, which can facilitate the installation of two ice-making trays arranged behind one another in a longitudinal direction. This applies in particular (but not only) if the ice-making trays are operated according to the twist-tray principle, i.e. the trays are not only rotatable into their discharge position, but are additionally twistable to cause or to assist the ice produced in the trays to break loose. In ice makers that operate according to the twist tray principle, the ice-making trays often do not exceed a set length, because as the tray length increases, the angle by which the tray is to twist so that the ice located therein can be broken loose reliably from the tray gets bigger. The construction space available inside household refrigerators or freezers is often considerably deeper than the normal length of a single ice-making tray. This available construction space can be used efficiently if two ice-making trays are arranged behind one another in the longitudinal direction of the tray. This does not increase the construction size of the ice-making assembly in a plane transverse to the longitudinal direction of the tray (or at any rate not substantially), but offers an increased ice production capacity compared with a single ice-making tray.

In this disclosure, an ice-making assembly means a pre-assemblable construction unit, which can be installed as such in a refrigerator or freezer.

In certain embodiments, the ice-making assembly further includes a rotary drive device supported on the frame structure for causing rotation of the first and second ice-making trays about the rotational axis. The rotary drive device includes a drive motor disposed adjacent to a first longitudinal end of one of the first and second ice-making trays where the other of the first and second ice-making trays is disposed adjacent to a second longitudinal end of the one of the first and second ice-making trays opposite the first longitudinal end. The drive motor is an electric motor, for example, and sits—seen in the tray longitudinal direction—beyond both ice-making trays, thus either in front of or behind the two trays. In other embodiments, the drive motor sits between the first and second ice-making trays.

To freeze water poured into the ice-making trays, a cold air flow is used in certain embodiments of the present invention, which sweeps past the ice-making trays on the underside of the tray bottom. So that both ice-making trays are covered by the cold air flow substantially along their overall length, the ice-making assembly may include a wall structure delimiting a cold air duct extending on the underside of the first and second trays from one to the other of the first and second ice-making trays. Cold air can flow in the cold air duct. The wall structure keeps the flowing cold air in contact with the ice-making trays, so to speak, and prevents it from being diverted prematurely, i.e. before it reaches the rear end of the rear ice-making tray (seen in the tray longitudinal direction). So that the wall structure arrangement does not stand in the fall path of the ice falling out upon emptying of the ice-making trays, thus when the ice produced therein is discharged from the trays, and obstruct the emptying process, the wall structure in certain embodiments includes a separate first wall member in relation to each of the first and second ice-making trays, each first wall member being arranged for movement relative to the frame structure. Each first wall member can be arranged, for example, for joint rotation with the respectively associated ice-making tray. Other movement patterns are naturally conceivable for the first wall members, for example a lateral (horizontal) movement out of the fall path of the ice produced.

So that the cold air duct can extend without interruption if possible from one ice-making tray to the other, the wall structure in certain embodiments further includes a second wall member interposed between the first wall members and arranged fixedly relative to the frame structure. The second wall member facilitates a seamless transition of the cold air duct to the adjacent first wall members.

In certain embodiments, the ice-making assembly comprises a tray-and-duct sub-assembly supported on the frame structure for rotation with respect to the frame structure about the rotational axis, the tray-and-duct sub-assembly including a channel member having the wall structure, the channel member defining a channel, wherein the first and second ice-making trays are accommodated in the channel and are supported on the channel member.

The channel member may include opposite channel end walls and an intermediate support wall, the first ice-making tray being arranged between, and supported on, a first of the channel end walls and the intermediate support wall, the second ice-making tray being arranged between, and supported on, the intermediate support wall and a second of the channel end walls.

Each of the first and second ice-making trays may be arranged for joint rotation with the channel member about the rotational axis and for twisting relative to the channel member about a twist axis extending parallel to the rotational axis.

According to another aspect, the invention provides a domestic refrigerator or freezer that includes an ice-making assembly and a container. The ice-making assembly includes a frame structure and first and second ice-making trays supported for rotation about a rotational axis with respect to the frame structure between an ice production position and an ice discharge position. The first and second ice-making trays are disposed behind one another in a direction of the rotational axis and each have a tray longitudinal dimension in the direction of the rotational axis that is larger than a tray width direction in a direction transverse to the rotational axis. The container is arranged under the first and second ice-making trays to collect ice discharged from the first and second ice-making trays.

Embodiments of the present invention will be explained in more detail hereinafter with reference to the enclosed drawings.

BRIEF DESCRIPTION OF THE DRAWINGS

FIG. 3 shows the ice-making assembly according to FIG. 2 in an installation situation relative to an ice collection container.

DETAILED DESCRIPTION

Figure 1A:
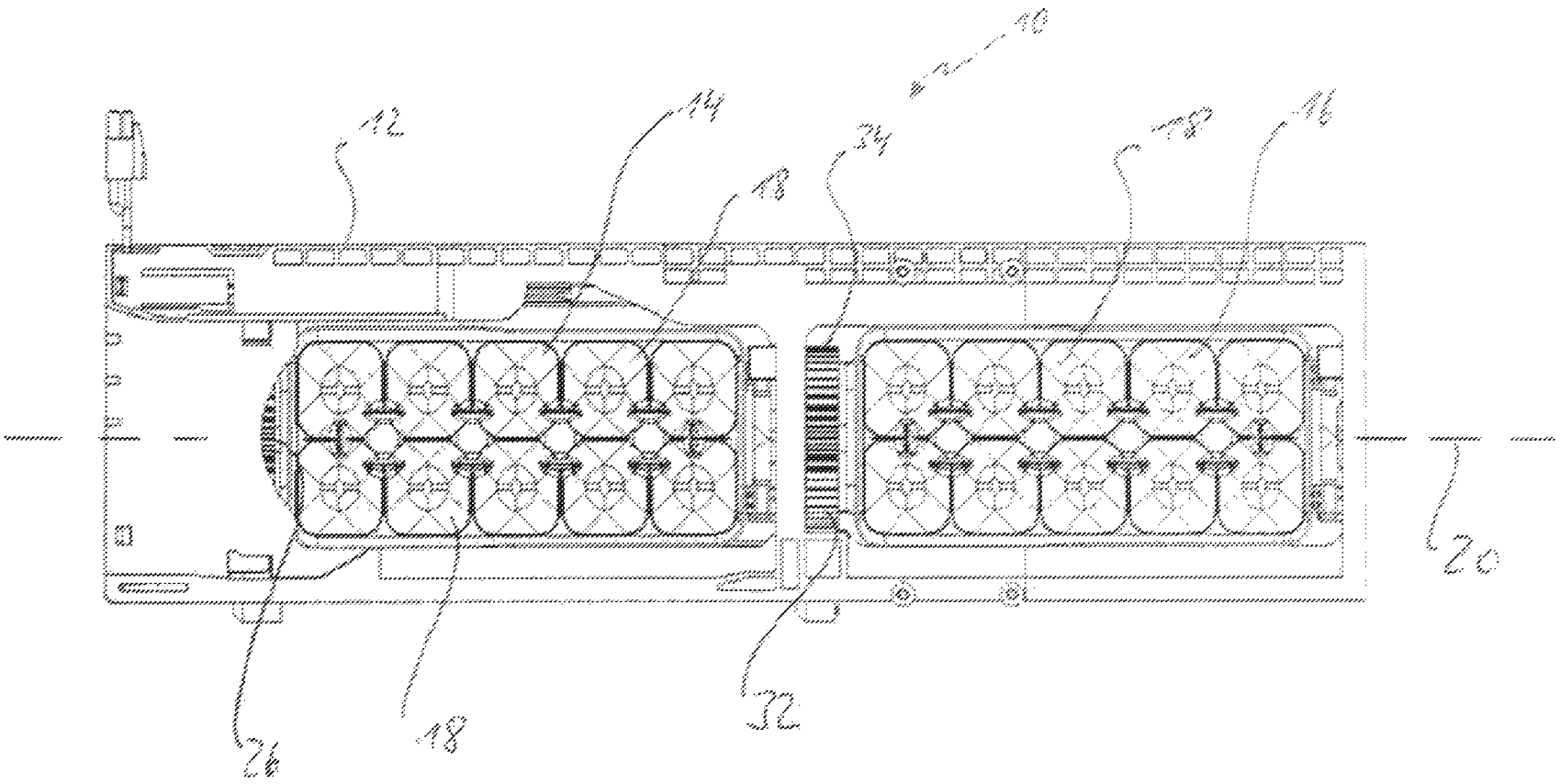
FIGS. 1*a* and 1*b* show an ice-making assembly according to a first embodiment in a top view and a view in perspective.
Figure 1B:
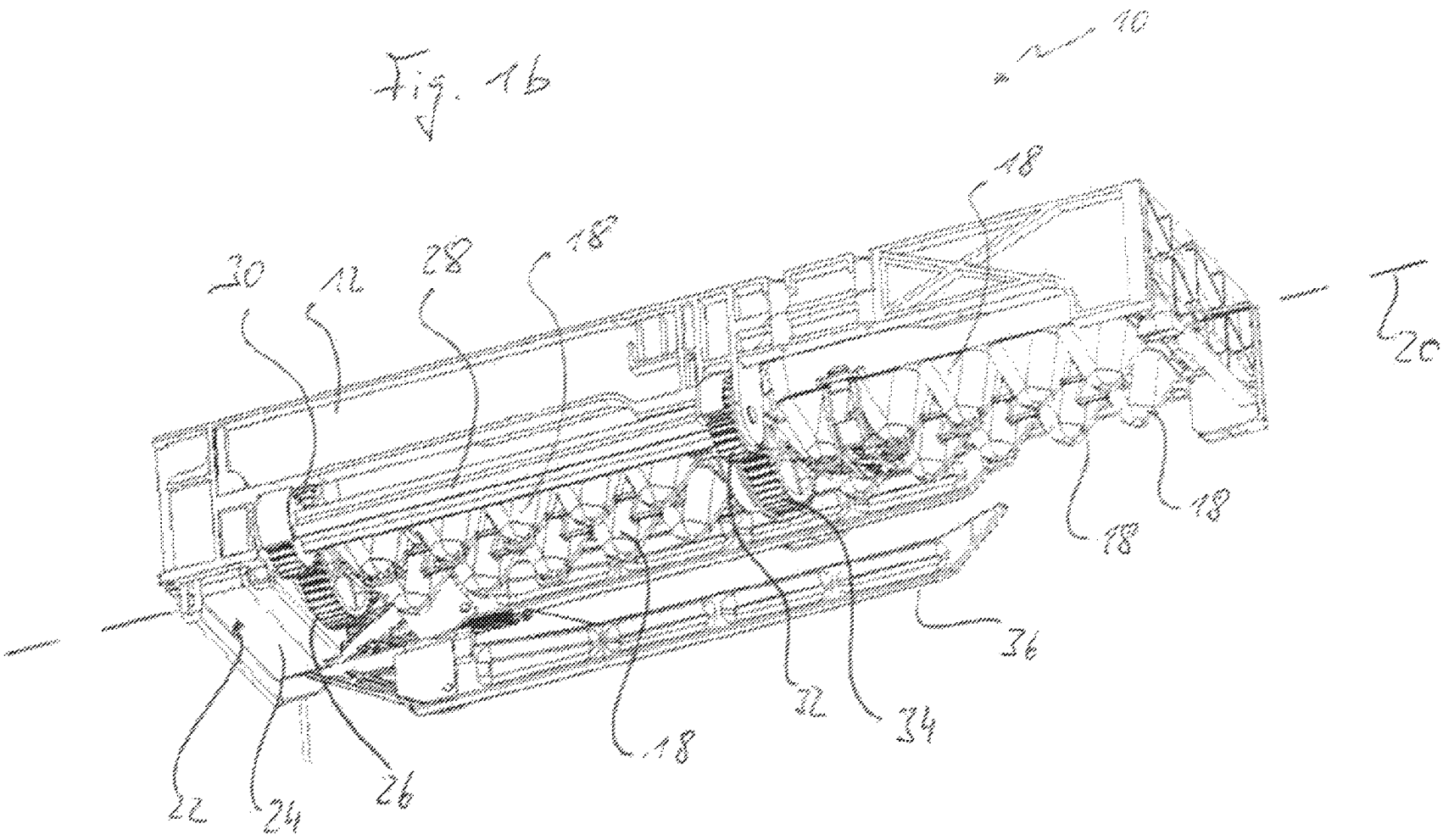

Reference is made first to FIGS. 1*a* and 1*b*. The ice-making assembly shown there, designated generally by 10, is used for installation in a domestic refrigerator or freezer, for example for insertion into a slide compartment provided for this inside the appliance. The ice-making assembly 10 has a main frame 12, which has a substantially rectangular outline (in a top view) and serves as a support for a first ice-making tray 14 and a second ice-making tray 16. Even if different reference numbers are used for the first and second ice-making trays 14, 16, they are nevertheless of identical construction in the example shown and are of the same size. Their shape is oblong, i.e. they are longer than they are wide. Seen in the longitudinal direction of the tray, the ice-making trays 14, 16 are inserted one behind the other into the main frame 12. The ice-making trays 14, 16 have a plurality of pot-shaped bulges 18 protruding downwards on the underside of the tray, each of which bulges forms a trough-like recess, or pocket, for the production of a single piece of ice (ice cube). In the example shown, each of the ice-making tray 14 has two parallel longitudinal rows of five bulges 18 in each case.

Both ice-making trays 14, 16 are rotatable relative to the main frame 12 about a common axis of rotation 20 running in a tray longitudinal direction. A rotary drive device generally designated 22 is used for the rotary drive of the ice-making trays 14, 16 relative to the main frame 12. The rotary drive device in the embodiment in FIGS. 1*a*, 1*b* comprises a drive unit 24 including, for example, an electric motor, which unit provides a drive torque via a drive shaft, which is not shown in greater detail. This drive torque is used to drive both ice-making trays 14, 16. To this end the drive unit 24 is coupled via a first transmission unit 26 to the first ice-making tray 14. A rod 28 connects a pinion 30 of the first transmission unit 26 to a pinion 32 of a second transmission unit 34, which is coupled to the second ice-making tray 16. The rod 28 is used to transmit a drive torque from the pinion 30 to the pinion 32 and consequently from the first transmission unit 26 to the second transmission unit 34. A synchronous drive of the two ice-making trays 14, 16 is possible via the first transmission unit 26 and the second transmission unit 32. By actuating the drive unit 24, therefore, both trays 14, 16 can be rotated from their ice production position shown in FIGS. 1*a*, 1*b*, in which they are aligned horizontally in the installation state, about the axis of rotation 20 into an ice discharge position, in which ice produced in the trough-like recesses formed by the bulges 18 can fall out of the trays. The trays 14, 16 are operated according to the twist-tray principle, i.e. they are rotated initially without inner torsion about a certain angle. Then, upon continued actuation of the drive unit 24, one of the longitudinal ends of each tray 14, 16 is rotated further, while the other longitudinal end is blocked against rotation (for example, by suitable stop faces on the main frame 12). This causes a torsion of each of the trays 14, 16 in itself, which aids detachment of the pieces of ice produced in the trays.

In the example shown, the drive unit 24 and the first transmission unit 26 are located beyond the two trays 14, 16 when seen in the longitudinal direction of the two trays 14, 16, while the transmission unit 34 sits between the two trays 14, 16. Specifically, the drive unit 24 and the first transmission unit 26 are installed in the main frame 12 in the example shown on the side of that longitudinal end of the ice-making tray 14 that is remote from the ice-making tray 16.

A lever 36 fitted pivotably on the main frame 12 is used to detect the filling level in a collection container (not shown in greater detail in FIGS. 1*a*, 1*b*), which container is arranged in the installed state, i.e. when the ice-making assembly 10 is installed in the refrigerator or freezer, underneath the ice-making assembly 10 and collects the pieces of ice falling out of the trays 14, 16. Depending on the filling level of this collection container, the lever 36 assumes a different pivot position, which can be detected, for example, by a switch or a potentiometer.

In FIGS. 2, 3, 4, 5*a*, and 5*b*, the same components or those with an identical function as in FIGS. 1*a*, 1*b* are provided with the same reference symbols, but supplemented with a small letter. Unless otherwise indicated below, reference is made to the above statements to explain these components.

Figure 2:
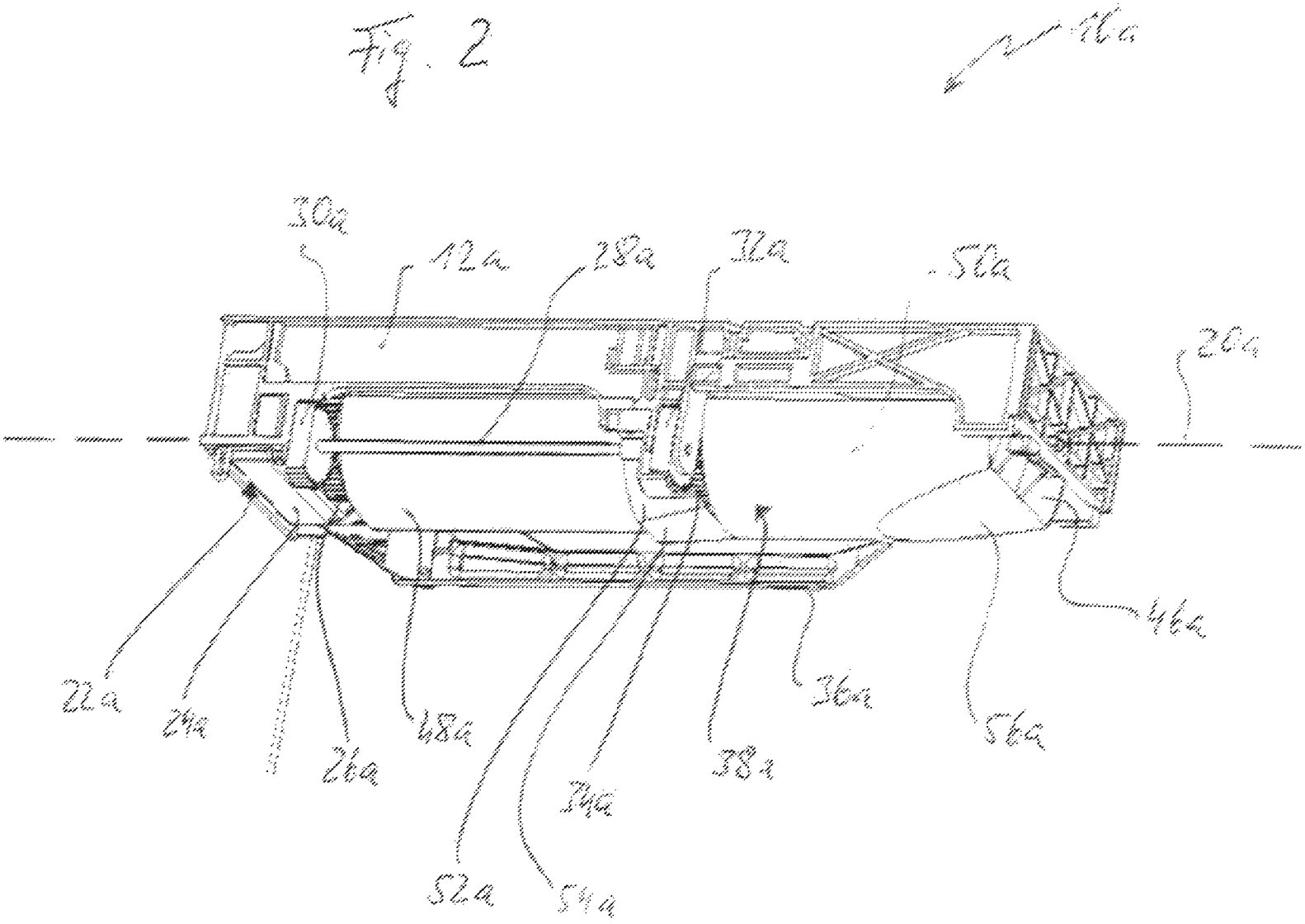
FIG. 2 shows a view in perspective of an ice-making assembly according to a second embodiment.
Figure 7:
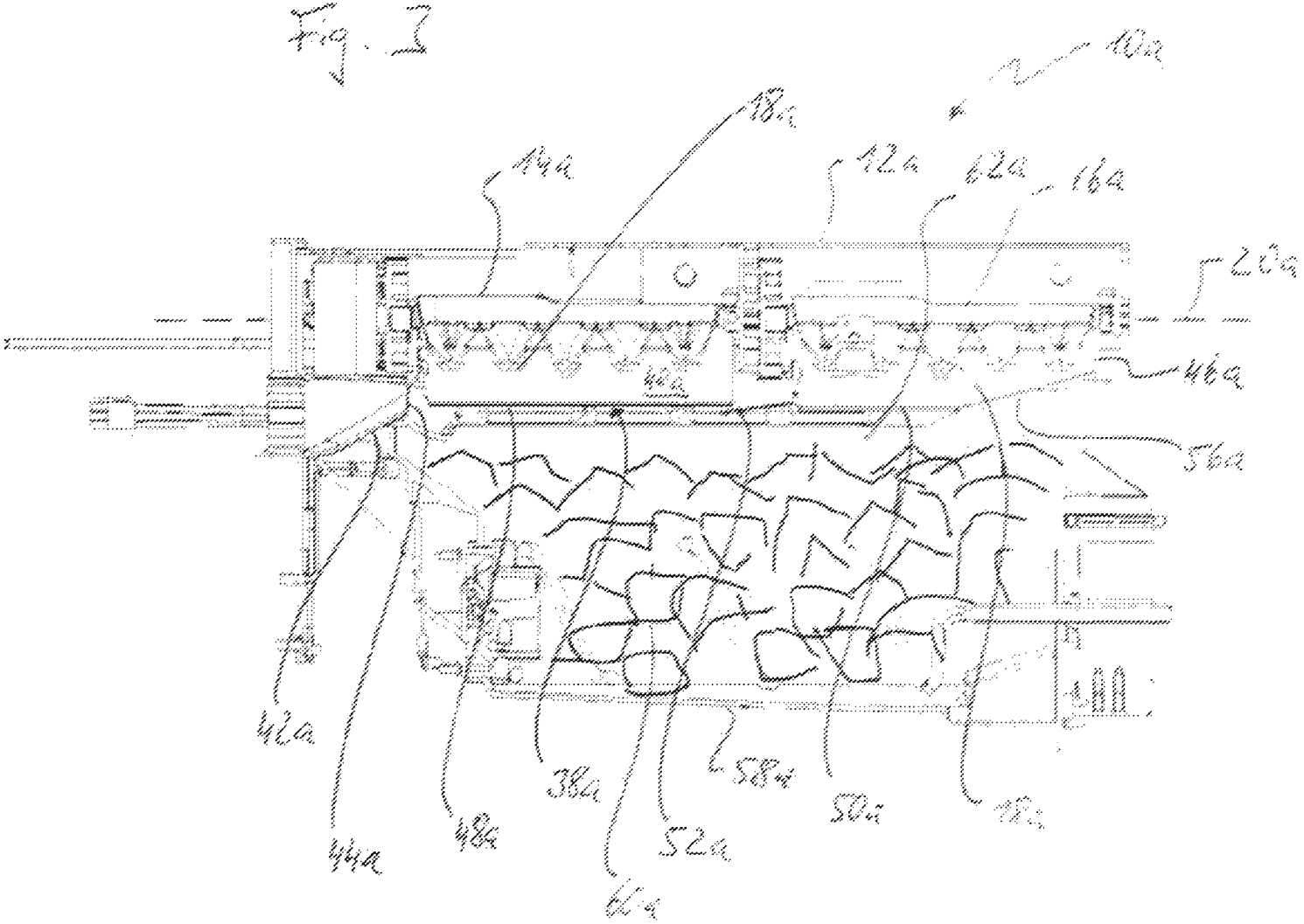

The embodiment in FIGS. 2 and 3 differs from that according to FIGS. 1*a*, 1*b* in that the ice-making assembly 10*a* additionally comprises a wall structure generally designated 38*a*, which is arranged underneath the ice-making trays 14*a*, 16*a* (with reference to the installation situation of the assembly 10*a*) and delimits a cold air duct 40*a* together with the trays 14*a*, 16*a*. The cold air duct 40*a* runs over the border between the two ice-making trays 14*a*, 16*a*, so that cold air, which is blown in the area of one longitudinal end of one of the trays 14*a*, 16*a* into the space between the tray in question and the wall structure 38*a*, flows past the relevant tray in a longitudinal tray direction underneath this, crosses the area between the two trays 14*a*, 16*a* and then flows past the other tray underneath this tray. The cold air is obtained from a cold air supply path system, of which an outlet portion 42*a* formed or held on the main frame 12*a* is shown in FIG. 3, which outlet portion tapers to an outlet opening 44*a*. Cold air flows out of the outlet opening 44*a*, which then enters the space between the ice-making tray 14*a* and the wall structure 38*a*, in other words enters the cold air duct 40*a* and flows in this as far as the distal longitudinal end of the ice-making tray 16*a*, where it exits at an exit opening 46*a* from the cold air duct 40*a*.

The wall structure 38*a* is composed in the example shown of several separately produced wall members comprising first wall members 48*a* and 50*a* and a fixed second wall member 52*a*. Located beneath the ice-making tray 14*a* is the movable first wall member 48*a*, which is arranged for joint rotation with the ice-making tray 14*a* so that it is not in the fall path of the pieces of ice falling out in the ice discharge position of the tray 14*a*. Located beneath the ice-making tray 16*a* is the movable first wall member 50*a*, which is arranged analogously to the wall member 48*a* for joint rotation with the ice-making tray 16*a*. The main frame 12*a* provides corresponding recesses in which the ice-making tray 14*a*, 16*a* and the movable first wall members 48*a*, 50*a* can rotate about the axis of rotation 20*a*. The space between the two movable first wall members 48*a*, 50*a* is bridged by the fixed second wall member 52*a*, which is arranged fixedly relative to the main frame 12*a*. A certain axial overlap can exist here between the fixed second wall member 52*a* and one or both of the movable first wall members 48*a*, 50*a*.

The movable first wall members 48*a*, 50*a* and the fixed second wall member 52*a* can be formed in cross section roughly in the shape of a channel or trough, for example. The movable first wall members 48*a*, 50*a* can be drawn up on both sides of the longitudinal edges of the respective ice-making tray 14*a*, 16*a*, so that the trays 14*a*, 16*a*—figuratively speaking—are sunk in the channels formed by the first wall members 48*a*, 50*a* or immersed in these. For a particularly efficient use of the cold air conveyed in the cold air duct 40*a* it can be advantageous if the first wall members 48*a*, 50*a* together with the ice-making trays 14*a*, 16*a* form a duct space that is closed all around in cross section. To do this, the wall surface sections 48*a*, 50*a* can contact the trays 14*a*, 16*a* laterally or be connected to these.

To achieve a continuously good cooling effect over the entire extent of the cold air duct 40*a*, the cross section size of the cold air duct 40*a* may decrease on the section from the outlet opening 44*a* to the exit opening 46*a* (leaving the inconsistencies on the underside of the trays 14*a*, 16*a* caused by the bulges 18*a* out of consideration). See the taper (bevel) of the fixed second wall member 52*a* indicated at 54*a* in this regard and the taper (bevel) of the movable first wall member 50*a* indicated at 56*a*.

In FIG. 3, a collection container 58*a* is also shown, in which the ice emptied from the trays 14*a*, 16*a* (indicated at 60*a*) is collected. The collection container 58*a* has a collection opening 62*a*, through which the ice from the trays 14*a*, 16*a* falls into the collection container 58*a*. The collection container 58*a* and with it the collection opening 62*a* are dimensioned to be sufficiently long so that both trays 14*a*, 16*a* behind one another have room above the collection container 58*a* and ice can fall from both trays 14*a*, 16*a* into the collection container 58*a*. The collection volume of the collection container 58*a* can be used uniformly in this way over the entire container length.

Figure 4:
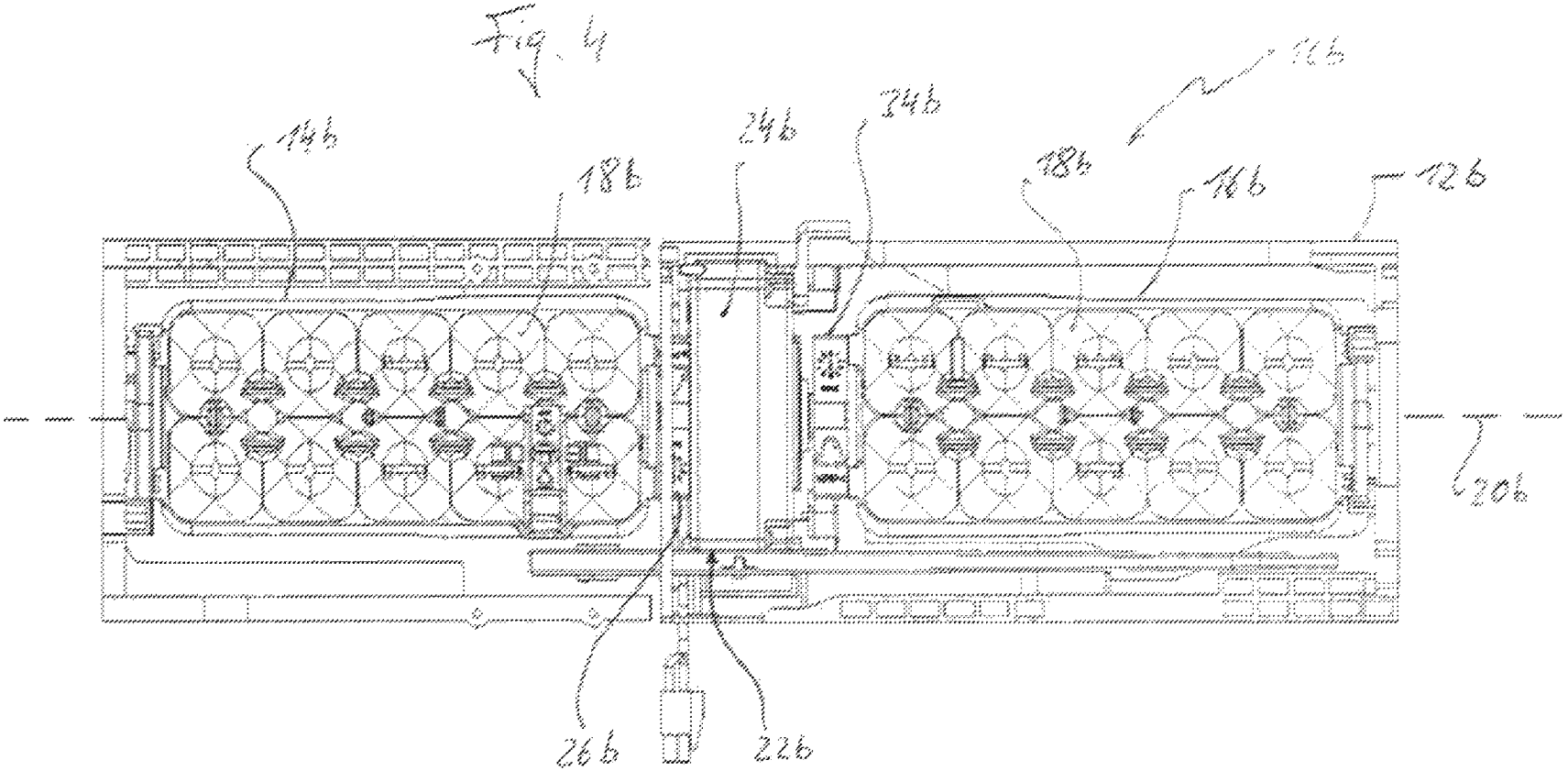
FIG. 4 shows a top view of an ice-making assembly according to a third embodiment.

Reference is now made to FIG. 4. The ice-making assembly 10*b* shown there differs from the embodiment according to FIGS. 1*a*, 1*b* due to another configuration of the rotary drive device 22*b*. In the embodiment according to FIG. 4, the rotary drive device 22*b* comprises a drive unit 24*b* installed between the first and second ice-making trays 14*b*, 16*b*. Situated on both sides of the drive unit 24*b* are transmission units 26*b*, 34*b*, via which the drive torque of the drive unit 24*b* is transmitted to the first ice-making tray 14*b* and the second ice-making tray 16*b*. A rod for bridging the distance from one longitudinal end of one of the first and second trays 14*b*, 16*b* to the other longitudinal end of this tray (as effected by the rod 28 in the embodiment according to FIGS. 1*a*, 1*b*) is not required in the embodiment according to FIG. 4.

Figure 5A:
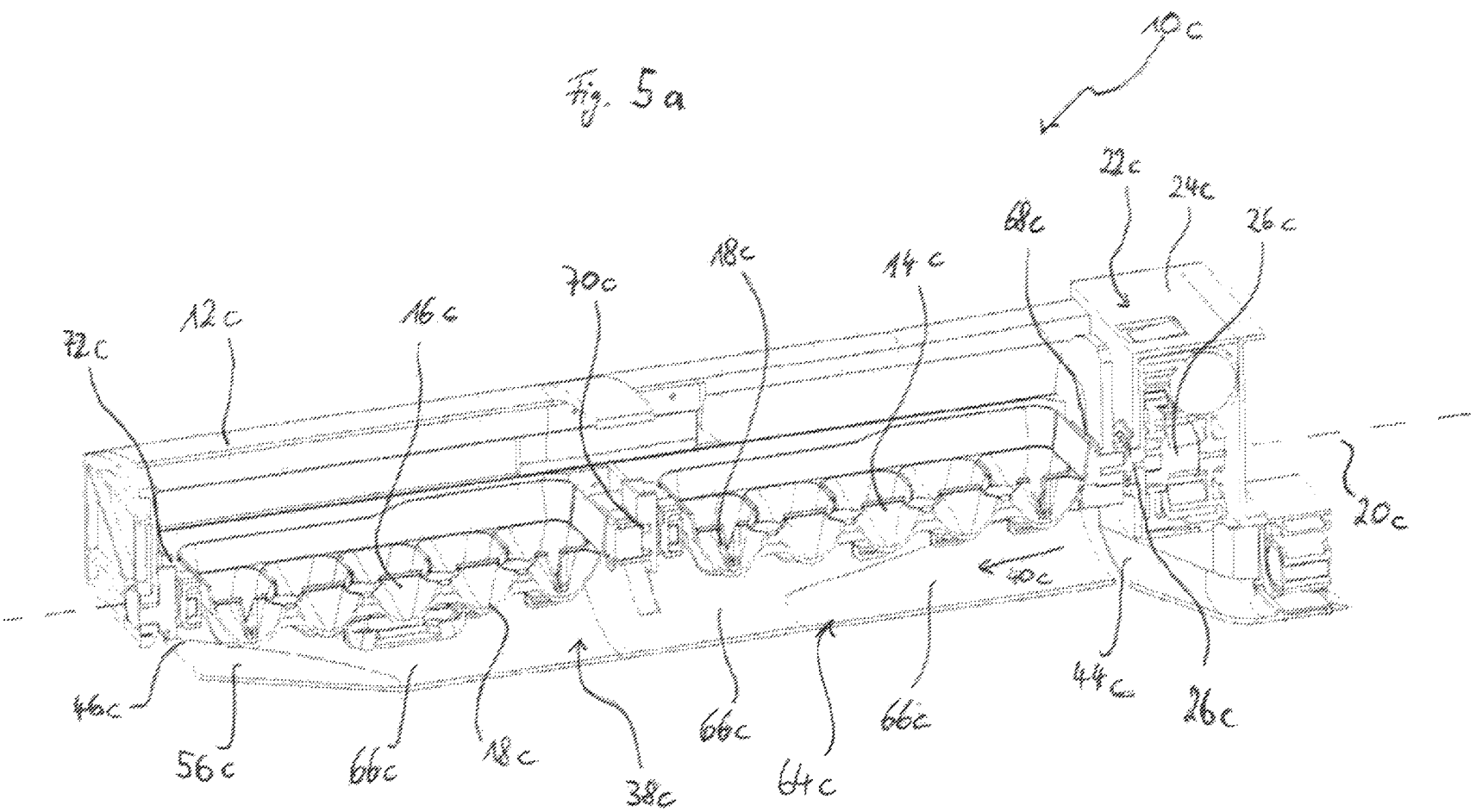
FIGS. 5*a* and 5*b* show perspective and top views, respectively, of an ice-making assembly according to a fourth embodiment.
Figure 5B:
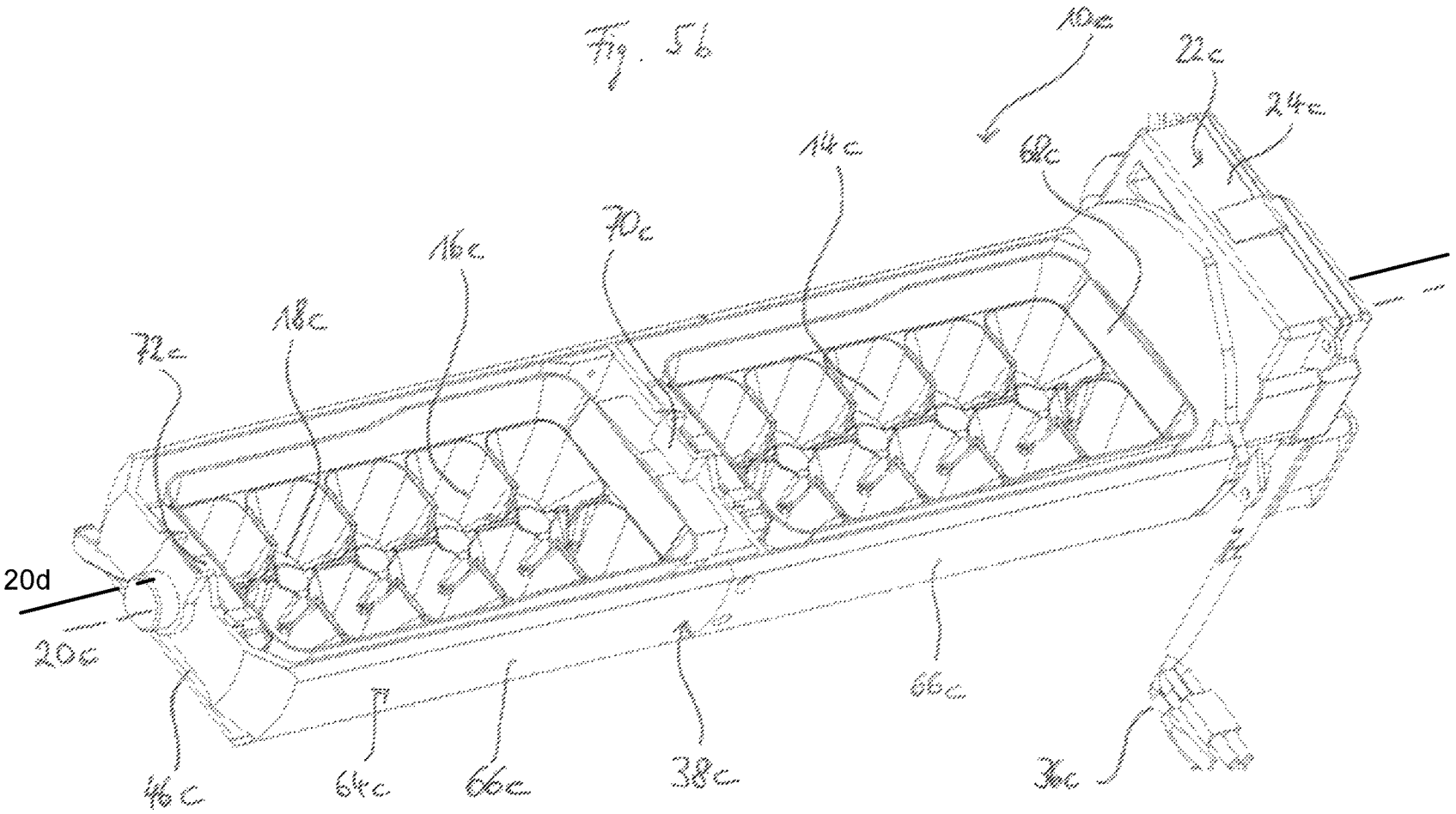

The ice-making assembly 10*c* according to the embodiment shown in FIGS. 5*a*, 5*b* comprises a tray-and-duct sub-assembly 64*c* including a channel member 66*c*. The channel member 66*c* is supported on the main frame 12*c* for rotation with respect to the main frame 12 about a rotational axis, which can be the rotational axis 20*c*, and forms the wall structure 38*c*. The channel member 66*c* defines a channel in which the first and second ice-making trays 14*c*, 16*c* are situated. The first and second ice-making trays 14*c*, 16*c* are supported by the channel member 66*c* for joint rotation with the channel member 66*c* about the mentioned rotational axis as well as for relative twisting movement with respect to the channel member 66*c* about a twist axis 20*d* that extends parallel to the rotational axis 20*c*. The wall structure 38*c* is formed as an integral part of the channel member 66*c*. Accordingly, the wall structure 38 is a unitary construction in the embodiment of FIGS. 5*a*, 5*b*. The channel member 66*c* and the first and second ice-making trays 14*c*, 16*c* can be preassembled to a construction unit forming the tray-and-duct sub-assembly 64*c*. The tray-and-duct sub-assembly 64*c*, in turn, can be assembled together with the main frame 12*c* and the and the rotary drive device 22*c* to form the ice-making assembly 10*c*.

The rotary drive device 22*c*, which is supported by the main frame 12*c*, comprises the transmission unit 26*c* to transmit a drive torque from the drive unit 24*c* to the tray-and-duct sub-assembly 64*c*.

The channel member 66*c* includes opposite channel end walls and an intermediate support wall. A first channel end wall 68*c* of the channel member 66*c* is formed at a first end of the channel member 66*c* which is coupled to the drive transmission unit 26*c*. A second channel end wall 72*c* of the channel member 66*c* is formed at the opposite second end of the channel member 66*c*. An intermediate support wall 70*c* of the channel member 66*c* is located between the first and second channel end walls 68*c*, 72*c*. The first ice-making tray 14*c* is arranged between the first channel end wall 68*c* and the intermediate support wall 70*c*, the second ice-making tray 16*c* is arranged between the intermediate support wall 70*c* and the second channel end wall 72*c*. The first ice-making tray 14*c* is supported in the region of one of its longitudinal ends on the first channel end wall 68*c* in a rotationally fixed manner and in the region of its opposite longitudinal end on the intermediate support wall 70*c* in a manner permitting a twisting rotational movement with respect to the channel member 66*c*. The second ice-making tray 146*c* is supported in the region of one of its longitudinal ends on the intermediate support wall 70*c* in a rotationally fixed manner and in the region of its opposite longitudinal end on the second channel end wall 72*c* in a manner permitting a twisting rotational movement with respect to the channel member 66*c*.

A synchronous drive of the first and second ice-making trays 14*c*, 16*c* is enabled via the channel member 66*c*. By actuating the drive unit 24*c*, therefore, the first and second ice-making trays 14*c*, 16*c* can both be rotated from an ice production position (similar to the situation shown in FIGS. 1*a*, 1*b*) in which they are aligned horizontally about the axis of rotation 20*c* into an ice discharge position, in which ice pieces produced in the bulges 18*c* can fall out of the ice-making trays 14*c*, 16*c*. Both ice-making trays 14*c*, 16*c* are operated according to the twist-tray principle. Then, upon continued actuation of the drive apparatus 24*c*, the end of the ice-making tray 14*c*, 16*c* arranged fixedly to the channel member 66*c* is rotated further, while the other end arranged for movement relative to the channel member 66*c* is blocked against rotation. This causes a torsion of each of the ice-making trays 14*c*, 16*c* in itself, which aids detachment of the pieces of ice produced in the trays.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An ice-making assembly for installation in a domestic refrigerator or freezer, the ice-making assembly comprising:

a frame structure;

first and second ice-making trays supported for rotation about a rotational axis with respect to the frame structure between an ice production position and an ice discharge position, wherein the first and second ice-making trays are disposed behind one another in a direction of the rotational axis and each have a tray longitudinal dimension in the direction of the rotational axis that s larger than a tray width direction in a direction transverse to the rotational axis;

a wall structure delimiting a channel in which the first and second ice-making trays are accommodated, a duct space being defined between the wall structure and the first and second ice-making trays to allow cold air to be blown into the duct space and flow in the duct space in a longitudinal tray direction underneath the first and second ice-making trays from one to the other of the first and second ice-making trays across an area between the first and second ice-making trays, wherein one of the following conditions (i) and (ii) is met:

(i) the wall structure includes a separate first wall member in relation to each of the first and second ice-making trays, each first wall member being arranged for joint rotation with one of the first and second ice-making trays relative to the frame structure; and (ii) the wall structure is a unitary construction formed as an integral part of a channel member delimiting the channel, each of the first and second ice-making trays being arranged for joint rotation with the channel member about the rotational axis relative to the frame structure.

2. The ice-making assembly according to claim 1, further comprising a rotary drive device supported on the frame structure for causing rotation of the first and second ice-making trays about the rotational axis, the rotary drive device including a drive motor disposed adjacent to a first longitudinal end of one of the first and second ice-making trays, wherein the other of the first and second ice-making trays is disposed adjacent to a second longitudinal end of the one of the first and second ice-making trays opposite the first longitudinal end.

3. The ice-making assembly according to claim 1, wherein the wall structure further includes a second wall member interposed between the first wall members and arranged fixedly relative to the frame structure.

4. The ice-making assembly of claim 1, wherein the channel member is supported on the frame structure for rotation with respect to the frame structure about the rotational axis, and the first and second ice-making trays are supported on the channel member.

5. The ice-making assembly of claim 4, wherein the channel member includes opposite channel end walls and an intermediate support wall, the first ice-making tray being arranged between, and supported on, a first of the channel end walls and the intermediate support wall, the second ice-making tray being arranged between, and supported on, the intermediate support wall and a second of the channel end walls.

6. The ice-making assembly of claim 4, wherein each of the first and second ice-making trays is arranged for twisting relative to the channel member about a twist axis extending parallel to the rotational axis.

7. A domestic refrigerator or freezer, comprising:

an ice-making assembly comprising:

a frame structure;

first and second ice-making trays supported for rotation about a rotational axis with respect to the frame structure between an ice production position and an ice discharge position, wherein the first and second ice-making trays are disposed behind one another in a direction of the rotational axis and each have a tray longitudinal dimension in the direction of the rotational axis that is larger than a tray width direction in a direction transverse to the rotational axis;

a wall structure delimiting a channel in which the first and second ice-making trays are accommodated, a duct space being defined between the wall structure and the first and second ice-making trays to allow cold air to be blown into the duct space and flow in the duct space in a longitudinal tray direction underneath the first and second ice-making trays from one to the other of the first and second ice-making trays across and area between the first and second ice-making trays, wherein one of the following conditions (i) and (ii) is met:

(i) the wall structure includes a separate first wall member in relation to each of the first and second ice-making trays, each first wall member being arranged for joint rotation with one of the first and second ice-making trays relative to the frame structure; and (ii) the wall structure is a unitary construction formed as an integral part of a channel member delimiting the channel, each of the first and second ice-making trays being arranged for joint rotation with the channel member about the rotational axis relative to the frame structure; and a container arranged under the first and second ice-making trays to collect ice discharged from the first and second ice-making trays.

* * * * *